US005650585A

United States Patent [19]

Pate et al.

[11] Patent Number: 5,650,585

[45] Date of Patent: Jul. 22, 1997

[54] IGNITOR FOR USE IN A LIQUID MONOPROPELLANT GAS GENERATOR

[75] Inventors: Robert Arthur Pate, Pittsfield; John Joseph Paul Johnson, Lee, both of Mass.; Keith James Schaefer, Nassau, N.Y.; John Mandzy, Pittsfield, Mass.

[73] Assignee: Martin Marietta Corporation, Bethesda, Md.

[21] Appl. No.: 453,112

[22] Filed: May 30, 1995

[51] Int. Cl.[6] ..... F41F 1/00

[52] U.S. Cl. ..... 89/7

[58] Field of Search ..... 89/7

[56] References Cited

U.S. PATENT DOCUMENTS

| | | | |
|---|---|---|---|
| 3,992,976 | 11/1976 | Bartels et al. | 89/7 |
| 4,745,841 | 5/1988 | Magoon et al. | 89/7 |
| 4,838,142 | 6/1989 | Birk | 89/7 |

*Primary Examiner*—J. Woodrow Eldred
*Attorney, Agent, or Firm*—Brian J. Rees; Geoffrey H. Krauss

[57] ABSTRACT

An initiator, for use in a gas generator, includes an enclosed volume in communication with apertures for introducing liquid propellant and pre-pressurization gas into a propellant ignition chamber, and an aperture for introducing combusted gasses into a gas generator. A mechanism for controlling when the gases are allowed to enter the gas generator, and a heater/electrode to initiate combustion of the liquid propellant, also communicate with the enclosed volume. The propellant and the pre-pressurization gas may be introduced together or through separate ports. The heater/electrode thermally decomposes and vaporizes the propellant causing pressurization of the ignition chamber until a critical value is reached and the propellant ignites and burns. The burning propellant increases the chamber pressure beyond a predetermined value thereby opening the controlling mechanism and allowing the combusted gases to be introduced into the gas generator combustion chamber.

20 Claims, 1 Drawing Sheet

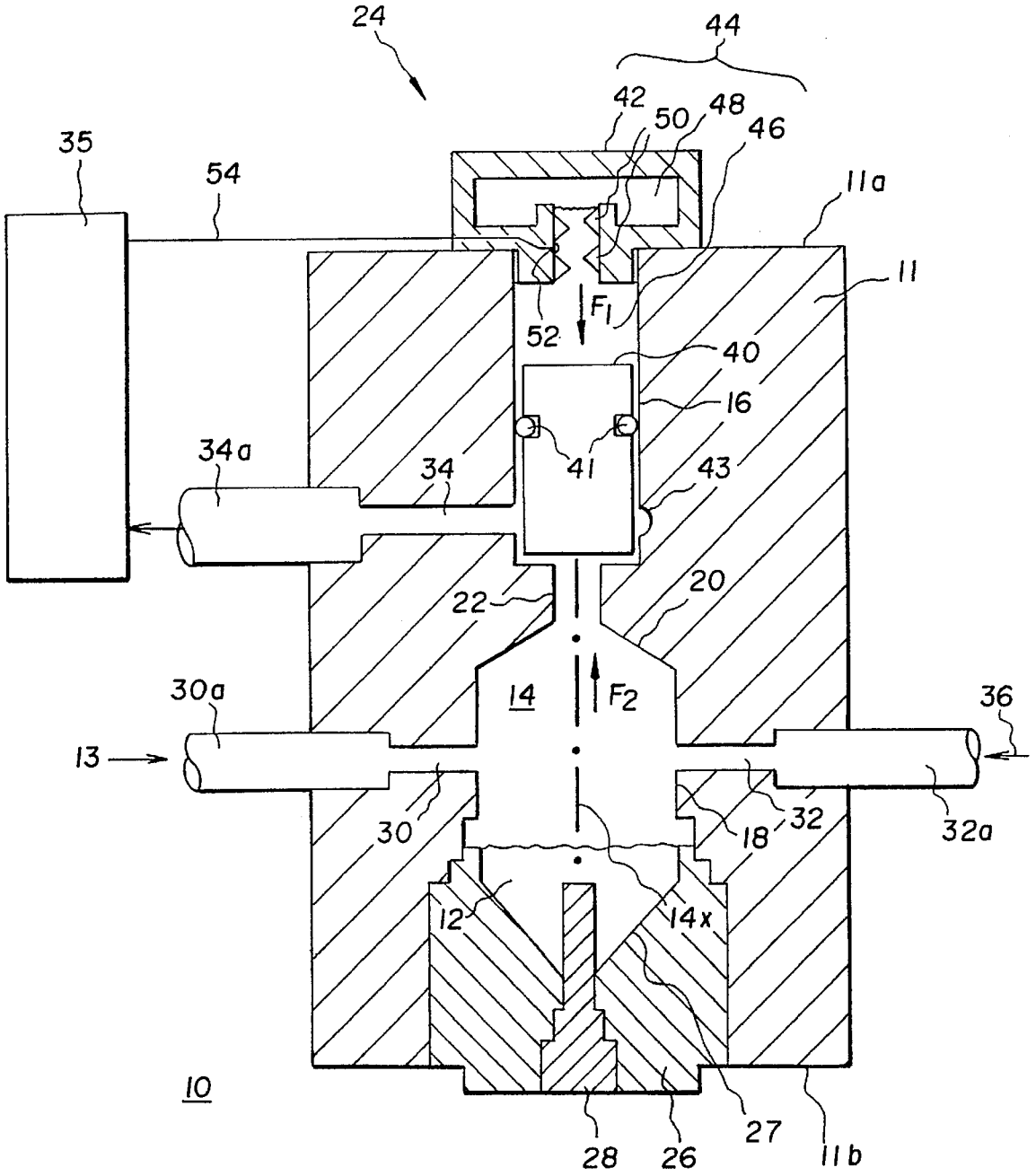
24
44
42
50
48
46
35
54
11a
11
F1
52
40
16
34a
34
41
43
20
22
14
F2
30a
36
13
30
32
18
32a
12
14x
10
28
26
27
11b

IGNITOR FOR USE IN A LIQUID MONOPROPELLANT GAS GENERATOR

BACKGROUND OF THE INVENTION

This invention relates generally to a propellant ignition system for use in a gas generator and, more particularly, to an ignitor for use in a gas generator utilizing a liquid monopropellant as a combined oxidizer/fuel source.

Over the past several decades there has been strong interest in liquid propellant technology, generally for use in propelling munitions. For example, U.S. Pat. No. 4,745,841, entitled "Liquid Propellant Gun", to Magoon et al, teaches a propellant gun wherein the mass rate of flow of a hydroxyl ammonium nitrate based liquid monopropellant can be repetitively, selectively and continuously varied throughout the interval of time of firing a single shot. This patent and all references cited therein are hereby incorporated herein in their entirety by reference. There are a number of energetic liquids which could be used for propelling munitions. For example, hydrazine and hydrogen peroxide are readily available. Hydrazine, however, is extremely toxic and requires stringent safeguards for human safety, while hydrogen peroxide, in concentrations of practical interest, is inherently unstable and is a severe fire hazard.

Liquid propellants are useful because copious amounts of gas are generated as the propellants burn, expand, and propel the munitions out from the gun barrel. Although large amounts of gas are produced, the reaction is an extremely short lived phenomenon, i.e., on the order of 10–20 milliseconds, and therefore liquid propellants have been heretofore limited in their applications. However, some applications need a substantial volume of gas delivered at a specified pressure over a given length of time, such as for the starting of rotating machinery (e.g., diesel engines and gas turbines), inflation of gas bags (e.g., deep sea salvage inflation devices and automotive air bags), and steady-state operation of turbine-driven machinery.

Filed concurrently herewith is U.S. patent application Ser. No. 08/452,901, entitled "Liquid Monopropellant Gas Generator", to K. Schaefer et al., which discloses and claims a liquid propellant gas generation system. This system includes a propellant storage tank, a motor-driven pump (or other pressurization means) to force the propellant into a combustion chamber, an injector to effectively break up the incoming liquid propellant into droplets that facilitate ignition and sustain combustion, an ignitor to initiate the combustion process, a nozzle to isentropically expand the exhaust gases in order to optimize the pressure and temperature of the exhaust gases, and exhaust ducting to direct the flow and handle further heat transfer requirements. The output of the gas generator may be varied either by throttling the exhaust gases or by setting up a plurality of continuous generators in a manifold assembly. This patent application and all references contained therein is hereby incorporated herein by reference.

One of the key elements of a liquid monopropellant gas generator is ensuring that the ignitor, which must ignite or initiate combustion of the propellant, creates an environment (pressure and/or temperature) within a combustion chamber of a gas generator to ensure combustion of the in-flowing propellant. Therefore, it is desirable to provide a simple and reliable ignitor to initiate combustion within a gas generator, particularly for igniting a liquid monopropellant, and for ensuring a proper environment for combustion in a liquid monopropellant gas generator.

OBJECTS OF THE INVENTION

A primary object of the present invention is to provide a novel ignitor suitable for use in a gas generator where the ignitor will initiate combustion of liquid monopropellant and create an environment which ensures proper initiation of a gas generator.

SUMMARY OF THE INVENTION

In accordance with the present invention, an ignitor includes means for introducing liquid propellant and a pre-pressurizing gas into an enclosed volume; a heater/electrode to supply energy to initiate the liquid propellant reaction within the enclosed volume; and means, remaining closed until predetermined requirements are met, for controlling the egress of the ignited propellant from the enclosed volume into a gas generator. The propellant and the pre-pressurization gas may be introduced together or separately. The heater/electrode initiates reaction of the propellant. The burning propellant increases the pressure within the enclosed volume beyond a predetermined value—opening the egress controlling means and introducing the burning liquid propellant into the gas generator combustion chamber.

BRIEF DESCRIPTION OF THE DRAWINGS

The subject matter which is regarded as the invention is particularly pointed out and distinctly claimed in the concluding portion of the specification. The invention, together with further objects and advantages thereof, may best be understood by reference to the following description taken in connection with the accompanying drawings in which the sole Figure is a cross-sectional view of a liquid monopropellant initiator of the present invention.

DETAILED DESCRIPTION

The sole figure shows an initiator 10 for initiating the combustion of a pool 12 of liquid propellant. Initiator 10 has a housing 11 surrounding an enclosed volume 14. Housing 11 may be manufactured from a broad class of materials, such as stainless steel and the like; any material capable of maintaining structural integrity at the temperatures and pressures associated with the combustion reaction of a liquid propellant is within the scope of the present invention.

A presently preferred initiator design includes a cylindrical initiator housing 11 having a top surface 11*a* and a bottom surface 11*b* with an enclosed volume 14 generally located therebetween. The specific structure of enclosed volume 14 can be varied without significantly affecting the properties of initiator 10. Those skilled in the art will understand that there are a multitude of designs and fabrication techniques, and it should be further understood that all such designs and fabrications techniques are within the scope of the present invention.

In accordance with one preferred embodiment of initiator 10, housing 11 is fabricated from a solid block of material, e.g., stainless steel. A butt-ended drill, i.e., a drill producing a hole with a bottom 16*a* substantially perpendicular to the hole-walls, is used to bore out an upper cavity 16 some distance into housing 11 from housing top 11*a*. An angular-tipped drill is used to bore out a bottom cavity 18 some distance into housing 11 from housing bottom 11*b*, but not so far as to connect with upper cavity 16. Then a smaller size drill is used to form a passage 22 which connects top cavity 16 and bottom cavity 18. This fabrication procedure leaves: bottom cavity 18 with a conical shaped tip portion 20; top cavity 16; and passage 22 communicating therebetween.

Lower cavity 18 may go through further fabrication steps and is "sealed off" by an initiator plug 26, e.g., sealing enclosed volume 14 from the exterior environment beyond the initiator bottom surface 11*b*. Once inserted, initiator plug 26 defines a lower boundary of lower cavity 18, enclosing volume 14 where the liquid propellant combustion reaction occurs, i.e., volume 14 will become the ignition chamber. Initiator plug 26 may have a multitude of designs, with the only limitation being that it must maintain the seal on lower cavity 18 under the pressure requirements of a liquid propellant combustion reaction. As shown, the top of initiator plug 26, which defines the lowermost portion of volume 14, may optionally have an inverted conically shaped portion 27; a conical shape tends to gravitationally position the propellant near heater/electrode 28 without excessive confinement during combustion. An electrode/heater element 28, discussed in detail hereinbelow, passes through a portion of housing 11 and intrudes into volume 14; as shown, element 28 extends through plug 26.

Disposed substantially perpendicular to the enclosed volume axis 14*x* are the axes of an inlet aperture 30, allowing the introduction of a liquid propellant stream 13 into enclosed volume 14 via a pipe 30*a*, an inlet aperture 32 for the introduction of a pre-pressurization gas 36 into enclosed volume 14 via a pipe 32*a*, and an outlet aperture 34 allowing the egress of the reaction products of liquid propellant 13 into an associated gas generator means 35 through pipe 34*a*. Optionally, inlet aperture 30 may introduce a pre-pressurization gas concurrently with, and as part of, liquid propellant 13, thereby eliminating any need for inlet 32 and pipe 32*a*. Pre-pressurization gas 36 may be any inert gaseous carrier capable of remaining stable under the temperature and pressure requirements of the liquid propellant combustion reaction, such as nitrogen and the like, or gas 36 may be a reactive gas providing fuel or oxidizer, such as methane, propane, oxygen, and the like.

Liquid propellant 13 may be a broad class of materials generally comprising liquid monopropellants or bipropellants. More specifically, preferred liquid propellants 13 used in the present invention comprise hydroxyl ammonium nitrate (HAN) combined with various aliphatic amine-nitrates (AANs). A presently preferred liquid propellant combustible material is an aqueous solution of HAN and triethanol ammonium nitrate (TEAN). The most preferred material used in the present invention comprises of 60.79% HAN, 19.19% TEAN and 20.02% water. Liquid propellant 13 is a colorless, odorless, completely homogeneous fluid with a mass density of about 1.43 grams/cc, a toxicity comparable to aspirin and corrosivity comparable to lemon juice. Liquid propellant 13 is reasonably energetic, with a mass impetus of about 898 Joules/gram and, at constant volume, burns at a temperature of about 2500° K. With this mass density and mass impetus, liquid propellant 13 has a volumetric impetus of 1284 Joules/cc, which corresponds to a very high volumetric efficient energy source compared to most solid propellants. The reaction is as follows:

$$7N_2H_4O_4+1C_6H_{16}N_2O_6+12H_2O \rightarrow 8N_2+6CO_2+34H_2O \quad [1]$$

As can be seen from Equation 1, the reaction products are all non-toxic gases: water (as super-heated steam); carbon dioxide and nitrogen gas.

Heater/electrode means 28, may be turned on before, during or after liquid propellant 13 is added to volume 14 and may be provided in a number of different configurations. Two presently preferred embodiments of heater/electrode means 28 are: a ruggedized electrical heater; and a continuous electrical arc. Either of these embodiments work on the basis of locally heating the propellant to the ignition temperature in the pre-pressurized condition. Either of these embodiments can also work on the basis of thermally decomposing and volatilizing initially unpressurized liquid propellant in pool 12 to the point where the temperature and pressure of the liquid propellant overcome the activation energy of the reaction in Equation 1, such that the combustion reaction is self sustaining and proceeds; but in the absence of pre-pressurization, said activation condition is achieved more slowly. Heater means 28 is removable and is preferably positioned within initiator plug 26, which allows heater means 28 to be replaced if damaged during the operation of initiator 10, or for any other reason. Furthermore, since the area surrounding heater/electrode means 28, i.e., the initiator-plug-conical-shape-portion 27, may also suffer from the vigorous propellant reaction, it too may be removed from initiator housing 11 and replaced if damaged.

In accordance with another aspect of the present invention, a poppet assembly 24 may be provided to "seal off" the upper cavity 16 from the exterior environment beyond the initiator housing top surface 11*a*. Poppet assembly 24 includes a poppet 40, slidably held by ring seals 41 within upper cavity 16, and a hydraulic fluid/gas sub-assembly 44 disposed above poppet 40. Poppet 40 may additionally have an annular groove 43, juxtaposed with aperture 34, for facilitating rapid egress of combustion products through aperture 34 while maintaining a symmetric pressure distribution on poppet 40. Hydraulic fluid/gas sub-assembly 44, includes a quantity of a hydraulic fluid 46 and a quantity of a gas 48 held in a housing 42. Hydraulic fluid 46 and gas 48 work together to ensure that a first inward force ($F_1$) is placed on poppet 40. Hydraulic sub-assembly 44 optionally have flow restrictors 50 disposed above poppet 40 to reduce any sudden changes in the flow of hydraulic fluid 46 or in the motion of poppet 40, and to facilitate measurement of a discernable pressure pulse indicating proper combustion.

In operation, poppet 40, responsive to the force ($F_1$) created by hydraulic sub-assembly 44 acting on popper 40, is initially in the inward position, sealed with surface 16*a* (as shown). With poppet 40 in the inward position, aperture 34 is closed off and no gasses may egress from enclosed volume 14. Liquid propellant 13 and a pre-pressurization gas 36 are respectively introduced into volume 14 through pipes 30*a* and 36*a* to form pool 12. Next, electrode 28 heats up and volatilizes the nearby liquid propellant of pool 12. Liquid propellant 13 begins to combust and produce the gaseous reaction products of Equation 1; these gases expand and produce pressure throughout enclosed volume 14. The expanding combustion gases impinge on the lower-cavity-conical-portion 20 and are directed inward toward axis 14*x*; this flow helps protect the edge of poppet 40 from the effects of high speed combustion gas flow. As the pressure within enclosed volume 14 reaches a predetermined value, the force ($F_2$) exerted by the combustion gases surpass the force ($F_1$) placed on popper 40 by hydraulic sub-assembly 44, and poppet 40 raises and opens outlet aperture 34. The combustion chamber pressure at which popper 40 raises is controlled by: selection of the ratio of gas 48 to fluid 46, i.e., the pressure of the gas 48 on the hydraulic fluid 46; selection of other aspects of hydraulic sub-assembly 44; selection of the diameter of outlet aperture 34 and the diameter and density of popper 40; alteration of the poppet differential area ratio (discussed hereinbelow); or selection of the degree of flow reduction by the flow restrictors 50.

In accordance with another aspect of the present invention, once the poppet starts to move, the area of popper 40 subject to rising pressure increases significantly from the area of passage 22 to the area of upper cavity 16—accelerating the outward movement of poppet 40 and therefore the opening of exhaust aperture 34. Advantageously, with poppet 40 in the inward and sealed position, exposed area (from passage 22) is relatively small—facilitating the relatively low hydraulic pressure to confine the monopropellant pool 12 for an adequate combustion reaction. Additionally, poppet 40 has a relatively high sectional density (ratio of mass to cross-sectional area) which renders the dynamic response largely inertially dominated and thus insensitive to the hydraulic pressure variations and facilitates adequate pressure confinement for combustion initiation without requiring an equal applied hydraulic pressure. As the combustion reaction proceeds and the pressure forces poppet 40 outward, there is a significant increase in the exposed area of poppet 40 subject to the pressure. This differential area effect helps the pressure more quickly accelerate poppet 40 during operation. Finally, after the reaction products are vented, the force ($F_1$) placed on poppet 40 by hydraulic sub-assembly 44 surpasses the pressure of now-reduced force ($F_2$) within volume 14, and poppet moves back into the "inward" position.

In accordance with another aspect of the present invention, poppet 40 is provided such that sealing surface 16*a* (i.e., where poppet 40 is connected to the butt end of upper cavity 16) is distinct from the gas velocity throttling surfaces. When combustion reaction gases expand and are then throttled, their velocity increases significantly and these high velocity hot gases tend to erode metal. As poppet 40 begins to move outward, the annular clearance between poppet 40 and upper cavity 16 becomes the flow restricting area. When poppet 40 raises sufficiently, passage 34 becomes the restricting orifice area. Thus, with this configuration, sealing surfaces 16*a* never become a throttling area and therefore is not exposed to the highest velocity hot gases. This preserves and extends the useful life of sealing surfaces 16*a*, and as a consequence extends the useful life of initiator 10.

Proper initiator operation requires that sufficient pressure is maintained on liquid propellant of pool 12 within volume 14 for initiating the liquid propellant reaction, and that the energetic gases are vented while still in a state capable of "initiating" the combustion of liquid propellant 13 in a gas generator 35 or other device. The combustion reaction of liquid propellant 13 of the present invention propagates at speeds on the order of milliseconds, which is higher than any typical control mechanisms can operate; popper assembly 24 of the present invention accomplishes both tasks and keeps poppet 40 in the inward position by imparting a predetermined force ($F_1$) while the enclosed volume 14 reaches the correct temperature and/or pressure for the reaction (Eqn. 1) to proceed. Then, the pressure within the enclosed volume creates an upward force ($F_2$) which exceeds force ($F_1$), thereby lifting poppet 40 and allowing the energetic reaction gases to exit enclosed volume 14 and enter gas generation means 35 while in an energetic state.

Initiator 10 may optionally have a pressure transducer 52, of well known type, placed within popper assembly 24, preferably between flow restrictors 50, to measure the pressure, or force ($F_2$), exerted on hydraulic sub-assembly 44 as the combustion reaction proceeds. This information is then sent via wire 54 to controlling electronic means (not shown) of gas generator means 35, signaling when a main propellant valve should open and close.

While a presently preferred embodiment of our liquid propellant initiator is described herein in some detail, many modifications and variations will become apparent to those skilled in the art; it is our intent to be limited only by the scope of the appending claims, and not by the specific details or instrumentalities present herein by way of description of the preferred embodiments.

What is claimed is:

1. A liquid propellant initiator, comprising:

an initiator housing having an enclosed volume, at least one aperture disposed in said housing for facilitating the introduction into said enclosed volume of at least a quantity of liquid propellant and at least a quantity of a pre-pressurization gas, and an aperture for providing egress of a combustion gas from said enclosed volume;

a heater/electrode means for causing said liquid propellant in said enclosed volume to ignite; and popper assembly means for controlling said egress of said combustion gas from said enclosed volume, wherein said combustion gas is produced from the heater/electrode means-induced interaction of said liquid propellant with said pre-pressurization gas.

2. The initiator of claim 1, where said enclosed volume has a combustion cavity devoid of any portion of said poppet assembly means, another cavity containing at least part of said popper assembly means and a middle-passage communicating between said combustion cavity and said another cavity.

3. The initiator of claim 2, where said combustion cavity has a conically-shaped portion closest to said middle passage.

4. The initiator of claim 2, where said poppet assembly means comprises: a poppet, slidably contained within said another cavity; and a hydraulic sub-assembly means disposed above said poppet for exerting a force urging said poppet toward said combustion cavity.

5. The initiator of claim 4, where said egress aperture extends through said housing so as to be substantially perpendicular to an axis of said enclosed volume, and where said egress aperture connects to said another cavity.

6. The initiator of claim 5, where said hydraulic sub-assembly means includes means for urging said poppet to a sealing position for said egress aperture.

7. The initiator of claim 6, where said poppet has a high sectional density having an inertially-dominated dynamic response.

8. The initiator of claim 6, where said hydraulic sub-assembly means are adapted to allow said poppet to move to a non-sealing position for said egress aperture when said combusted gases produce another force within said enclosed volume exceeding said hydraulic-sub-assembly-force.

9. The initiator of claim 8, where said poppet-sealing surface does not substantially throttle said egressing gases.

10. The initiator of claim 8, where said egressing combustion gases are sent to a liquid propellant gas generator.

11. The initiator of claim 2, where said initiator housing has a cylindrical shape about said axis and where said heater/electrode means is axially aligned with said axis.

12. A liquid propellant initiator, comprising:

an initiator housing having an enclosed volume, an aperture disposed in said housing for facilitating the introduction into said enclosed volume of at least a quantity of liquid propellant and a pre-pressurization gas, and an aperture for providing egress of a combustion gas from said enclosed volume;

a heater/electrode means for causing said liquid propellant in said enclosed volume to ignite; and poppet assembly means for controlling said egress of said combustion gas from said enclosed volume, wherein said combustion gas is produced from the heater/electrode means-induced interaction of said liquid propellant with said pre-pressurization gas.

13. The initiator of claim 12, where all of said openings are disposed substantially perpendicular to an axis of said housing.

14. The initiator of claim 13, where said enclosed volume has a combustion cavity devoid of any portion of said poppet assembly means, another cavity containing at least part of said poppet assembly means and a middle-passage communicating therebetween.

15. The initiator of claim 14, where said poppet assembly means comprises: a poppet, slidably contained within said another cavity; and a hydraulic sub-assembly means, disposed above said poppet, for exerting a force urging said poppet toward said combustion cavity.

16. The initiator of claim 15, where said egress aperture connects to said another cavity, and where egress aperture is sealed when said hydraulic sub-assembly means urges said poppet toward said combustion cavity.

17. The initiator of claim 16, where said hydraulic sub-assembly means is adapted to allow said poppet to move to a non-sealing position for said egress aperture when said combusted gases produce another force within said enclosed volume exceeding said hydraulic-sub-assembly-force.

18. The initiator of claim 17, where said poppet has a high sectional density and further having an inertially-dominated dynamic response.

19. The initiator of claim 17, where said poppet-sealing surface does not substantially throttle said egressing gases.

20. The initiator of claim 17, where said egressing combustion gases are sent to a liquid propellant gas generator.

* * * * *